United States Patent [19]

Dutartre et al.

[11] 4,073,178

[45] Feb. 14, 1978

[54] DEVICE FOR COLD FORGING THE HOLLOW, SPHERICAL HEADS OF BALL-JOINT PIVOTS

[75] Inventors: Maurice Dutartre, Boulogne Billancourt; Yves Roger, Meudon La Foret, both of France

[73] Assignee: Regie Nationale des Usines Renault, Boulogne-Billancourt, France

[21] Appl. No.: 718,034

[22] Filed: Aug. 26, 1976

[51] Int. Cl.[2] ..... B21D 22/00

[52] U.S. Cl. ..... 72/352; 72/433

[58] Field of Search ..... 72/352, 356, 431–434

[56] References Cited

U.S. PATENT DOCUMENTS

| | | | |
|---|---|---|---|
| 2,811,057 | 10/1957 | Vosler et al. | 72/431 |
| 3,036,366 | 5/1962 | Ricks | 72/356 X |
| 3,108,502 | 10/1963 | Chatfield | 72/433 X |
| 3,138,257 | 6/1964 | Andersen | 72/431 X |
| 3,537,291 | 11/1970 | Hawkins | 72/352 X |

*Primary Examiner*—Leon Gilden

*Attorney, Agent, or Firm*—Oblon, Fisher, Spivak, McClelland & Maier

[57] ABSTRACT

A device is provided for precision cold forging of hollow, spherical heads of ball-joint pivots of the type used in the steering and suspension joints of automobiles, which includes a pair of hemispherical forming dies closing on a joint plane passing almost through the center of the ball-joint. One of the dies containing the pivot rod of the ball-joint pivot is clamped onto a tool-holder unit against a bearing edge situated almost on a level with the center of the ball-joint and of the joint plane, with an end part thereof receiving a thrust from a flexible element which opposes the forming pressure of the hollow, spherical head and assures that the die is permanently supported on the bearing edge. Precision cold forging of hollow, spherical forms, mass-produced with finite dimensions is thus available.

4 Claims, 1 Drawing Figure

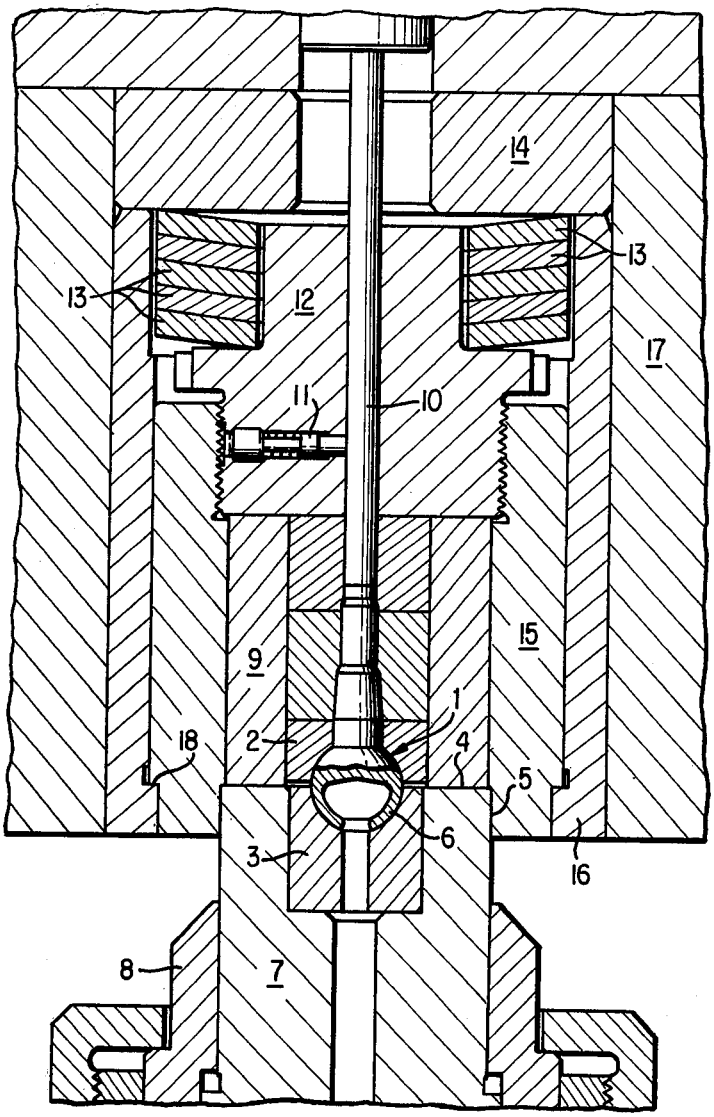
14
13
13
12
17
11
10
15
9
1
18
2
4
5
6
3
16
8
7

DEVICE FOR COLD FORGING THE HOLLOW, SPHERICAL HEADS OF BALL-JOINT PIVOTS

BACKGROUND OF THE INVENTION

1. Field of the Invention

The present invention concerns the manufacture of pivots having a hollow, spherical head, or ball, of the type used in the suspension or steering joints in the automobile industry made by cold forging.

2. Description of the Prior Art

In manufacturing processes such as This, the spherical head is casually formed by an initial reverse threading, giving the end of the pivot an almost hemispherical base of attachment to its rod, extended toward the extremity by a threaded, tubular part. This form is then placed between two hemispherical dies, which push the outer edge of the tubular part inwards, resulting in an almost spherical outer form and an inner cavity, also practically spherical, open on its extremity.

The advantage of this hollow shape, in addition to a savings in metal, which can be considerable in mass production, lies in the lesser amount of energy needed for forming the hollow, spherical head, compared with the forming of a solid ball-joint. The lighter parts are also advantageous, particularly for the suspension elements connected to the wheels, which therefore are unsuspended, and must be as light as possible.

Very narrow manufacturing tolerances are required for the dimensions of the heads and have, up until now, necessitated machining after the forging operation.

SUMMARY OF THE INVENTION

A primary object of the present invention is to eliminate this costly final machining operation by making the rough spherical forging heads at the required tolerances through an improvement in the die equipment producing the final spherical configuration of the ball-joint.

This object, and others as well, are attained, according to the present invention, by clamping the die receiving the rod of the pivot and the connecting part of the ball-joint onto a tool-holder unit on a supporting edge thereof situated almost on a level with the center of the ball-joint, its other end being supported by a flexible element exerting a bearing thrust on the other die, opposed to the forming pressure. This arrangement allows expansion of the die against the flexible element from a plane of reference passing through the center of the ball-joint.

According to another feature of the present invention, the dies forming the spherical head close, in a known manner, along the reference joint plane perpendicular to the axis of the pivot and passing through the center of the ball-joint, fitting into each other by means of a centering and guiding bearing centered on the axis of the pivot.

According to still another feature of the invention, the die pushing the extremity of the ball-joint is slide-mounted against a spring for a certain part of its travel of approach, before stopping against the forming element, which assures that the part is pushed far enough into the opposing die before the forming pressure is exerted.

These arrangements guarantee that the reciprocal positions of the dies at their joint plane, and of the forming semi-spheres will remain unchanged, however much their operating temperatures increase, which, otherwise, would affect the precision of the forging and would not allow the required tolerances to be maintained, due to modifications in the relative position of the dies when they expand, in particular the expansion of the die which receives the body of the pivot and is therefore heated more. It should be noted that the expression "cold forging" as used here is only relative, given the considerable heating which the parts undergo through their high deformation rates. It is the heating which, through the high rhythm of forming achieved, is transmitted to the equipment and threatens the forming precision when this equipment is heated and expanded.

BRIEF DESCRIPTION OF THE DRAWING

Various other objects, features and attendant advantages of the present invention will be fully appreciated as the same becomes better understood from the following detailed description, when considered in connection with the accompanying drawing, wherein the sole FIGURE is an axial section view of equipment for forging a hollow ball-joint, at the end of the operation, according to this invention.

DETAILED DESCRIPTION OF A PREFERRED EMBODIMENT

A preferred example of an embodiment of the invention will now be described, referring to the sole FIGURE of the drawing, wherein a part 1, being a pivot rod, at the end of forming, has its hollow ball-joint head formed between dies 2 and 3, closing on a joint plane 4, by centering themselves in a guide assembly 5, sufficiently high to insure this guiding from the initial contact of the edge 6 to be formed of part 1, which is at this time tubular in shape, with the hemispherical cavity of die 3.

The joint plane 4 includes, traditionally, a space for removing the burr in the diametrical plane of the ball-joint. This burr is cut off in a subsequent operation.

The die 3 is mounted in a support block 7, which in turn is slide-mounted in a guide 8. When edge 6 first contacts die 3, block 7 slides in guide 8, contracting the flexible units, not shown, until it stops against the forming element of the press, also not shown, whose thrust on block 7 and die 3 then causes the forming of edge 6. The prior flexible bearing force of block 7 assures the proper positioning in the forming die of part 1 before the forming work begins.

The die 2 is traditionally formed by a piling of blocks mounted in a binder 9. It includes a central ejector 10 and a retaining finger 11, mounted in an end or bottom part 12. This part bears against a series of extremely tight springs 13, which may, for example, be of the Belleville washer type. These springs are set against a thrust element 14. Bottom part 12, bearing against the binding 9 of die 2, is screwed into a sleeve 15, sliding within a sleeve 16 of one piece with tool-holder 17 and bearing against thrust part 14.

Sleeve 15 bears against an edge or shoulder 18 of sleeve 16 under the thrust of part 10 and springs 13. This edge 18 is almost on a level with joint plane 4 of dies 2 and 3, where the center of the ball-joint is situated.

Since the bearing force of springs 13 greatly exceeds the forging pressure, sleeves 15 and 16 consequently bear continually against their edge 18.

On the other hand, expansion of the equipment during operation will occur from joint plane 4 and edge 18, always on a level with the center of the ball-joint. This expansion will be expressed only by a corresponding contraction of springs 13. It will be perceptible at binding 9, which will transmit it to bottom part 12, much less perceptible at sleeve 15, and negligible at sleeve 16, which undergoes heating from the part only through four successive joints.

Sleeve 15 and die block 7 undergo almost identical thermal effects. The greater contribution of heat by part 1 is compensated by greater distance and an additional separating joint for sleeve 15, in relation to support block 7. The result is that the clearance of guide-fitting 5 will remain constant and may be low in value.

These arrangements make it possible to maintain a high degree of forming precision independently of the thermal conditions of the equipment.

Obviously, many modifications and variations of the present invention are possible in light of these teachings. It is to be understood, therefore, that within the scope of the appended claims, the present invention may be practiced otherwise than as specifically described herein.

What is claimed as new and desired to be secured by Letters Patent of the United States is:

1. A device for the precision cold forging of hollow, spherical heads of ball-joint pivots comprising:

a pair of hemispherical forming dies closing on a joint plane passing almost through the center of the ball-joint, the pivot rod of said ball-joint pivot being maintained in one of the dies, along an axis perpendicular to the joint plane;

a tool holder providing a bearing edge situated almost on a level with said joint plane of the dies;

said die containing said pivot rod being clamped on said tool holder with one end thereof against said bearing edge;

a flexible element providing a thrust against the opposite end of said die containing said pivot rod, said thrust being higher and opposite to the forming pressure created during said forging of said hollow, spherical heads and assuring that said one of said dies is permanently maintained against said bearing edge.

2. A device according to claim 1, wherein said die forming the hollow head of said ball-joint is slidably mounted in said tool-holder under the action of a spring-thrust exerted in opposition to the forming pressure and which is lower than the pressure of initial deformation of the part, and receives this part in its forming element before the forming pressure is exerted directly on the said die.

3. A device according to claim 1, wherein said die receiving the pivot rod bears on a bottom part bearing against said flexible element and screwed into a sleeve which bears, under the action of said flexible element, in opposition to the forming pressure, against said bearing edge of said tool-holder of the press.

4. A device according to claim 1, characterized by the fact that said flexible element comprises a series of Belleville washers.

* * * * *